US011455958B2

(12) United States Patent
Park et al.

(10) Patent No.: US 11,455,958 B2
(45) Date of Patent: Sep. 27, 2022

(54) DISPLAY DEVICE AND DRIVING METHOD OF THE SAME

(71) Applicant: Samsung Display Co., Ltd., Yongin-si (KR)

(72) Inventors: Sehyuk Park, Seongnam-si (KR); Hyojin Lee, Yongin-si (KR); Hui Nam, Suwon-si (KR); Jinyoung Roh, Hwaseong-si (KR); Bong Hyun You, Seoul (KR); Eunho Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/347,468

(22) Filed: Jun. 14, 2021

(65) Prior Publication Data

US 2021/0312871 A1 Oct. 7, 2021

Related U.S. Application Data

(63) Continuation of application No. 16/721,564, filed on Dec. 19, 2019, now Pat. No. 11,037,507.

(30) Foreign Application Priority Data

Dec. 26, 2018 (KR) ..... KR10-2018-0168873

(51) Int. Cl.
*G09G 3/3275* (2016.01)

(52) U.S. Cl.
CPC ..... *G09G 3/3275* (2013.01); *G09G 2330/028* (2013.01); *G09G 2370/08* (2013.01)

(58) Field of Classification Search
CPC ..... G09G 3/3275; G09G 2330/028; G09G 2370/08
See application file for complete search history.

(56) References Cited

U.S. PATENT DOCUMENTS

| | | | | |
|---|---|---|---|---|
| 10,157,574 | B2 | 12/2018 | Park et al. | |
| 2016/0035260 | A1* | 2/2016 | Kim | G09G 3/3614 345/212 |
| 2017/0092191 | A1 | 3/2017 | An et al. | |
| 2018/0048853 | A1 | 2/2018 | Koh et al. | |

FOREIGN PATENT DOCUMENTS

| | | | |
|---|---|---|---|
| KR | 10-2015-0059385 | A | 6/2015 |
| KR | 10-2016-0015451 | A | 2/2016 |
| KR | 10-2017-0060662 | A | 6/2017 |
| KR | 10-2017-0091139 | A | 8/2017 |

OTHER PUBLICATIONS

Extended European Search Report for corresponding European Application No. 19219551.9 dated Mar. 10, 2020, 11 pages.

* cited by examiner

*Primary Examiner* — Kenneth B Lee, Jr.
(74) *Attorney, Agent, or Firm* — Lewis Roca Rothgerber Christie LLP

(57) ABSTRACT

A display device includes: a display panel including a plurality of pixels; and a driving controller configured to: generate a data signal corresponding to an input image data; generate a data voltage based on the data signal; and output the data voltage to the pixels, wherein the driving controller is configured to output the data signal in at least one driving frequency higher than a predetermined low frequency during an image transition period in a low frequency driving mode during which the data signal outputs in the low frequency.

9 Claims, 10 Drawing Sheets

FIG. 5

| | 1ST LOW FREQUENCY(LP1) | IMAGE TRANSITION PERIOD(CP) | 2ND LOW FREQUENCY(LP2) |
|---|---|---|---|
| FREQUENCY | LF1 | CF1 → CF2 → CF3 → CF4 | LF2 |
| IMAGE | IMG1 | IMG2 | IMG2 |
| DS | DS1 | DS2 | DS2 |

FIG. 6A

| | 1ST LOW FREQUENCY(LP1) | IMAGE TRANSITION PERIOD(CP) | 2ND LOW FREQUENCY(LP2) |
|---|---|---|---|
| FREQUENCY | 1Hz | 60Hz → 30Hz → 15Hz → 7Hz → 5Hz | 1Hz |

FIG. 6B

| | 1ST LOW FREQUENCY(LP1) | IMAGE TRANSITION PERIOD(CP) | 2ND LOW FREQUENCY(LP2) |
|---|---|---|---|
| FREQUENCY | 2Hz | 60Hz → 35Hz → 10Hz → 15Hz → 3Hz → 4Hz → 3Hz | 2Hz |

FIG. 6C

| | 1ST LOW FREQUENCY(LP1) | IMAGE TRANSITION PERIOD(OP) | 2ND LOW FREQUENCY(LP2) |
|---|---|---|---|
| FREQUENCY | 2Hz | 60Hz → 30Hz → 30Hz → 10Hz → 4Hz → 4Hz → 4Hz | 2Hz |

FIG. 6D

| | 1ST LOW FREQUENCY(LP1) | IMAGE TRANSITION PERIOD(CP) | 2ND LOW FREQUENCY(LP2) |
|---|---|---|---|
| FREQUENCY | 1Hz | 60Hz → 60Hz → 30Hz → 30Hz → 15Hz → 15Hz → 5Hz | 2Hz |

DISPLAY DEVICE AND DRIVING METHOD OF THE SAME

CROSS-REFERENCE TO RELATED APPLICATIONS

This application is a continuation of U.S. patent application Ser. No. 16/721,564, filed Dec. 19, 2019, which claims priority to and the benefit of Korean Patent Application No. 10-2018-0168873, filed Dec. 26, 2018, the entire content of both of which is incorporated herein by reference.

BACKGROUND

1. Field

Aspects of some example embodiments relate generally to a display device and driving method of the same.

2. Description of the Related Art

Flat panel display (FPD) devices are widely used as a display device of electronic devices because FPD devices are relatively lightweight and thin compared to cathode-ray tube (CRT) display devices. Examples of FPD devices include liquid crystal display (LCD) devices, field emission display (FED) devices, plasma display panel (PDP) devices, and organic light emitting display (OLED) devices.

Low frequency driving methods may be used in order to decrease the power consumption of the OLED display device. When an image displayed on the display panel is changed in a low frequency driving mode, there is a problem that a sticking image of a previous image may be generated.

The above information disclosed in this Background section is only for enhancement of understanding of the background of the invention and therefore it may contain information that does not constitute prior art.

SUMMARY

Some example embodiments provide a display device capable of improving display quality.

Some example embodiments provide a driving method of the display device capable of improving display quality.

According to an aspect of some example embodiments, a display device may include a display panel including a plurality of pixels and a driving controller configured to generate a data signal corresponding to an input image data, generate a data voltage based on the data signal, and output the data voltage to the pixels. The driving controller may output the data signal in at least one driving frequency higher than a predetermined low frequency during an image transition period in a low frequency driving mode during which the data signal outputs in the low frequency.

According to some example embodiments, the driving controller may sequentially decrease the driving frequency during the image transition period.

According to some example embodiments, the driving controller may non-sequentially change the driving frequency during the image transition period.

According to some example embodiments, the driving controller may output the data signal in a first driving frequency and a second driving frequency.

According to some example embodiments, the first frequency may be higher than the second driving frequency.

According to some example embodiments, the first driving frequency may be lower than the second driving frequency.

According to some example embodiments, the driving controller may output the data signal at least once in the first driving frequency.

According to some example embodiments, the driving controller may output the data signal at least once in the second driving frequency.

According to some example embodiments, the driving controller may output the data signal in the predetermined low frequency before the image transition period and after the image transition period.

According to some example embodiments, the driving controller may output the data signal in the predetermined low frequency before the image transition period and output the data signal in a low frequency different from the predetermined low frequency after the image transition period.

According to some example embodiments, when a first input image data is changed to a second input data in the low frequency driving mode, the driving controller may drive the display panel to include a first low frequency period configured to output a first data signal corresponding to the first input image data in a first low frequency, an image transition period configured to output the second data signal corresponding to the second input image data in at least one driving frequency, and a second low frequency period configured to output a second data signal corresponding to the second input image data in a second low frequency.

According to some example embodiments, the second low frequency may be the same as the first low frequency.

According to some example embodiments, the second low frequency may be different from the first low frequency.

According to some example embodiments, the driving frequency may be sequentially decreased during the image transition period.

According to some example embodiments, the driving frequency may be non-sequentially changed during the image transition period.

According to some example embodiments, at least one of the driving frequency in which the second data signal outputs during the image transition period may be higher than the first low frequency.

According to some example embodiments, the second data signal may be output in a first driving frequency and a second driving frequency during the image transition period.

According to some example embodiments, the second driving frequency may be lower than the first driving frequency.

According to some example embodiments, the second driving frequency may be higher than the first driving frequency.

According to some example embodiments, the second data signal may be output in the first driving frequency at least once during the image transition period.

According to some example embodiments, the second data signal may be output in the second driving frequency at least once during the image transition period.

According to some example embodiments, the driving controller may include a driving mode determiner configured to determine a driving mode of the display panel, a data signal generator configured to generate the data signal corresponding to the input image data, determine a driving frequency of the data signal, and output the data signal based on the driving frequency, and a data voltage generator configured to generate the data voltage based on the data signal.

According to some example embodiments, the data signal generator may output the data signal in at least one driving frequency during the image transition period in the low frequency driving mode According to an aspect of some example embodiments, a driving method of a display device may include an operation of determining a driving mode of a display panel, an operation of determining whether or not an image transition occurs when the display panel is driven in a low frequency driving mode, an operation of outputting a data signal corresponding to an input image signal in at least one driving frequency in response to determining the image transition occurs in the low frequency driving mode.

According to some example embodiments, the driving frequency may be sequentially decreased when the image transition occurs.

According to some example embodiments, the driving frequency may be non-sequentially changed when the image transition occurs.

According to some example embodiments, the data signal may be output in a predetermined low frequency in the low frequency driving mode, and the data signal may be output in at least one driving frequency higher than the predetermined low frequency when the image transition occurs.

According to some example embodiments, the data signal may be output in a first driving frequency and a second driving frequency when the image transition occurs.

According to some example embodiments, the first driving frequency may be higher than the second driving frequency.

According to some example embodiments, the first driving frequency may be lower than the second driving frequency.

According to some example embodiments, the data signal may be output at least one time in the first driving frequency.

According to some example embodiments, the data signal may be output at least one time in the second driving frequency.

Therefore, the display device and the driving method of the display device may prevent or reduce instances of a sticking image being generated due to a response speed of a pixel by outputting the data signal in at least one driving frequency higher than the predetermined low frequency when the image is changed in the low frequency driving mode. Further, the display device and the driving method of the display device may prevent or reduce instances of a flicker being generated due to a rapid luminance change by outputting the data signal in at least one driving frequency.

BRIEF DESCRIPTION OF THE DRAWINGS

Illustrative, non-limiting example embodiments will be more clearly understood from the following detailed description taken in conjunction with the accompanying drawings.

FIG. 5 is a diagram illustrating for describing an operation of a data signal generator included in the driving controller of FIG. 4.

FIGS. 6A-6D illustrate examples for describing an operation of the data signal generator included in the driving controller of FIG. 4.

DETAILED DESCRIPTION

Hereinafter, aspects of some example embodiments of the present inventive concept will be explained in more detail with reference to the accompanying drawings.

Figure 1:
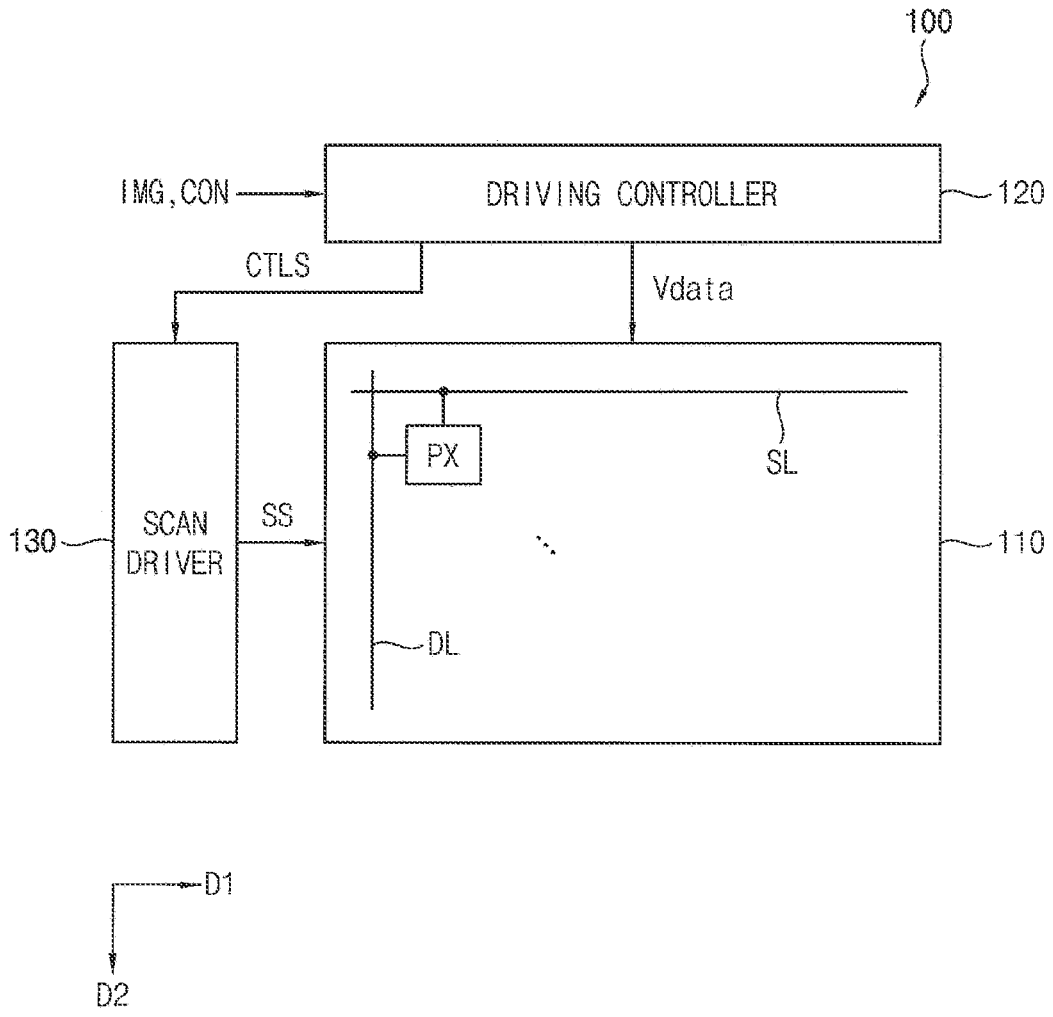
FIG. 1 is a block diagram illustrating a display device according to some example embodiments.
Figure 2A:
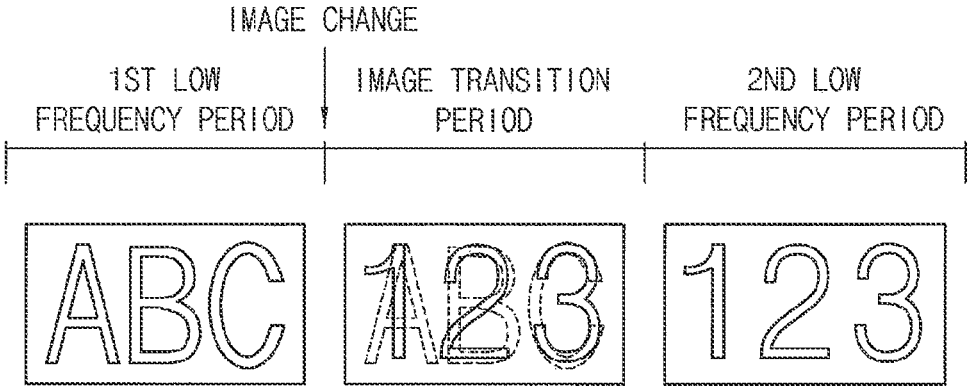
FIG. 2A is a diagram illustrating for describing aspects of related art.
Figure 2B:
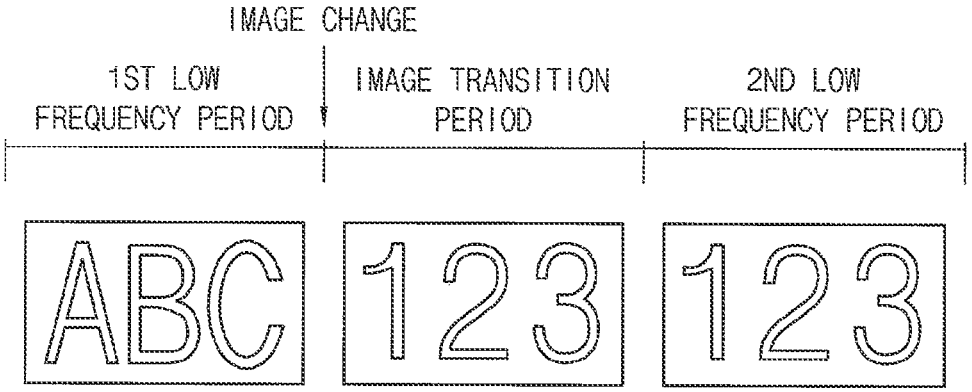
FIG. 2B is a diagram illustrating for describing aspects of some example embodiments of the present invention.
Figure 3:
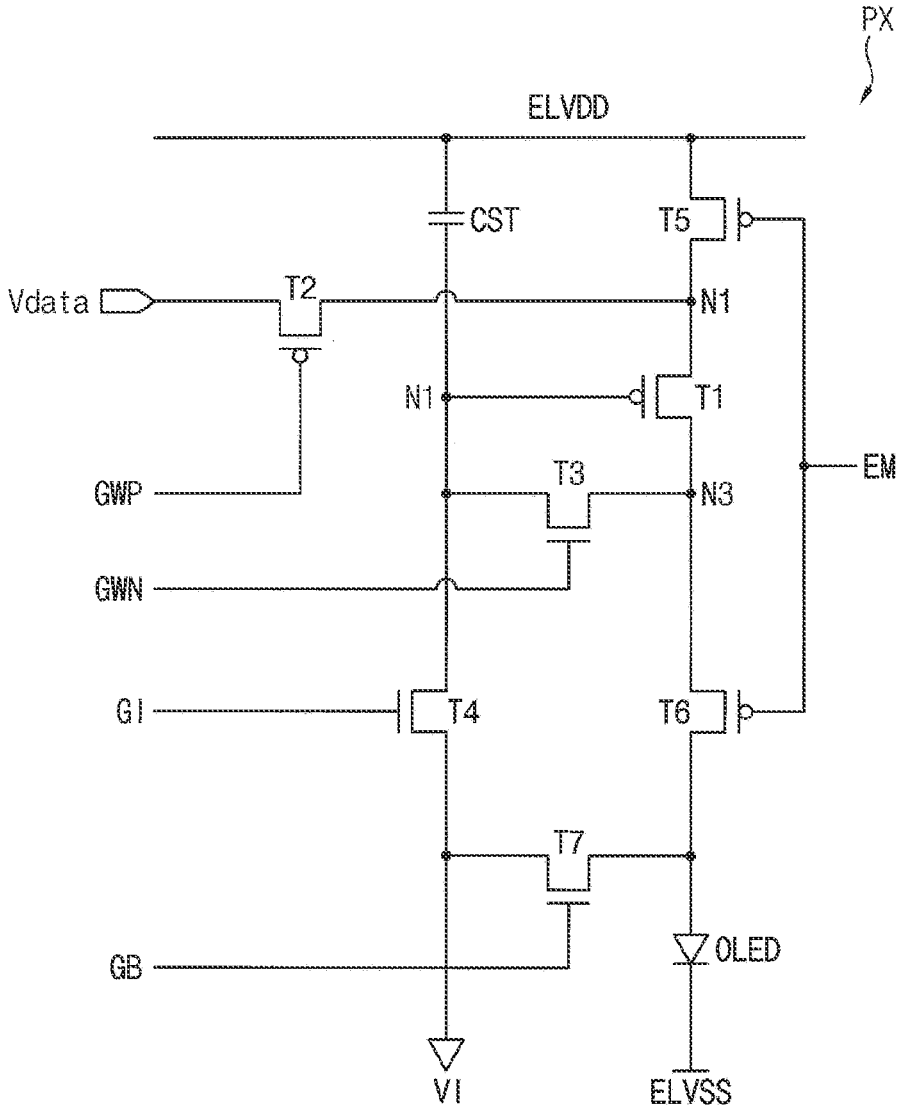
FIG. 3 is a circuit diagram illustrating an example of a pixel included in the display device of FIG. 1.

FIG. 1 is a block diagram illustrating a display device according to some example embodiments. FIG. 2A is a diagram illustrating for describing aspects of related art. FIG. 2B is a diagram illustrating for describing aspects of some example embodiments of the present invention. FIG. 3 is a circuit diagram illustrating an example of a pixel included in the display device of FIG. 1.

Referring to FIG. 1, a display device 100 may include a display panel 110, a driving controller 120, and a scan driver 130.

Generally, when an input data is a still image, the display device may drive the display panel in a low frequency to reduce power consumption. Referring to FIG. 2A, the when an image displayed on the display panel is changed in a low frequency driving mode, there may be a problem in which a sticking image of a previous image is generated due to a response speed of a pixel PX as described in FIG. 2A. The display device 100 of FIG. 1 may prevent or reduce instances of a sticking image being generated on the display panel 110 by outputting a data signal in at least one driving frequency during an image transition period during which the image is changed in the low frequency driving mode as described in FIG. 2B. Hereinafter, the display device 100 will be described in more detail.

The display panel 110 may include data lines DL, scan lines SL, and a plurality of pixel PX. The scan lines SL may extend in a first direction D1 and be arranged in a second direction D2 perpendicular to the first direction D1. The data lines DL may extend in the second direction D2 and be arranged in the first direction D1. The first direction D1 may be parallel with a long side of the display panel 110 and the second direction D2 may be parallel with a short side of the display panel 110. Each of the pixels PX may be located between or near intersection regions of the data lines DL and the scan lines SL.

Referring to FIG. 3, each of the pixels PX may include switching elements of a first type and switching elements of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching elements of the first type may be P-channel metal oxide semiconductor (PMOS) transistors and the switching elements of the second type may be N-channel metal oxide semiconductor (NMOS) transistors.

For example, data writing gate signals GWP and GWN may include a first data writing gate signal GWP and a second data writing gate signal GWN. The first data writing gate signal GWP may be provided to the PMOS transistor and have an activation signal of a low level in a data writing timing of the pixel PX. The second data writing gate signal GWN may be provided to the NMOS transistor and have an activation signal of a high level in the data writing timing of the pixel PX.

Each of the pixels PX may include first through seventh switching elements T1, T2, T3, T4, T5, T6, and T7, a storage capacitor CST, and an organic light emitting diode OLED. The first switching element T1 may have a gate electrode coupled to a first node N1, a first electrode coupled to a second node N2, and a second electrode coupled to a third node N3. For example, the first switching element T1 may be a polysilicon thin film transistor. The first switching element T1 may be a PMOS transistor. The first electrode of the first switching element T1 may be a source electrode and the second electrode of the first switching element T1 may be a drain electrode. The second switching element T2 may have a gate electrode to receive the first data writing gate signal GWP, a first electrode to receive a data voltage Vdata, and a second electrode coupled to the second node N2. For example, the second switching element T2 may be a polysilicon thin film transistor. The second switching element T2 may be a PMOS transistor. The first electrode of the second switching element T2 may be a source electrode and the second electrode of the second switching element T2 may be a drain electrode. The third switching element T3 may have a gate electrode to receive the second data writing gate signal GWN, a first electrode coupled to the first node N1, and a second electrode coupled to the third node N3. For example, the third switching element T3 may be an oxide thin film transistor. The third switching element T3 may be an NMOS transistor. The first electrode of the third switching element T3 may be a source electrode and the second electrode of the third switching element T3 may be a drain electrode. The fourth switching element T4 may have a gate electrode to receive a data initialization gate signal GI, a first electrode to receive an initialization voltage VI, and a second electrode coupled to the first node N1. For example, the fourth switching element T4 may be an oxide thin film transistor. The fourth switching element T4 may be the NMOS transistor. The first electrode of the fourth switching element T4 may be a source electrode and the second electrode of the fourth switching element T4 may be a drain electrode. The fifth switching element T5 may have a gate electrode to receive an emission control signal EM, a first electrode to receive a high power voltage ELVDD, and a second electrode coupled to the second node N2. For example, the fifth switching element T5 may be a polysilicon thin film transistor. The first electrode of the fifth switching element T5 may be a source electrode and the second electrode of the fifth switching element T5 may be a drain electrode. The sixth switching element T6 may have a gate electrode to receive the emission control signal EM, a first electrode coupled to the third node N3, and a second electrode coupled to an anode electrode of the organic light emitting diode OLED. For example, the sixth switching element T6 may be a polysilicon thin film transistor. The sixth switching element T6 may be a PMOS transistor. The first electrode of the sixth switching element T6 may be a source electrode and the second electrode of the sixth switching element T6 may be a drain electrode. The seventh switching element T7 may have a gate electrode to receive an organic light emitting diode initialization gate signal GB, a first electrode to receive the initialization voltage VI, and a second electrode coupled to the anode electrode of the organic light emitting diode OLED. For example, the seventh switching element T7 may be an oxide thin film transistor. The seventh switching element T7 may be an NMOS transistor. The first electrode of the seventh switching element T7 may be a source electrode and the second electrode of the seventh switching element T7 may be a drain electrode. The storage capacitor CST may have a first electrode to receive the high power voltage ELVDD and a second electrode coupled to the first node N1. The organic light emitting diode OLED may have the anode electrode and a cathode electrode to receive a low power voltage ELVSS. The pixel PX of FIG. 3 may prevent or reduce instances of leakage current occurring at the gate electrode of a driving transistor (e.g., the first switching element T1) in a low frequency driving mode. Thus, a display quality of the display device 100 may improve.

The driving controller 120 may generate the data signal corresponding to the input image data IMG and generate the data voltage Vdata based on the data signal, and output the data voltage Vdata to the pixels PX.

The driving controller 120 may determine a driving mode of the display panel 110 based on the input image data IMG. For example, the driving controller 120 may drive the display panel 110 in a high frequency driving mode when the input image data IMG is a moving image and drive the display panel in the low frequency driving mode when the input image data IMG is the still image.

The driving controller 120 may output a data signal based on the driving mode of the driving mode of the display panel 110. The driving controller 120 may convert the input image data IMG to the data signal by applying an algorithm for compensating the input image data IMG provided from an external device. The driving controller 120 may output the data signal at a high frequency (e.g., a predetermined high frequency) when the display panel 100 is driven in the high frequency driving mode. For example, the high frequency (e.g., the predetermined high frequency) may be higher than 60 Hz. For example, the high frequency (e.g., the predetermined high frequency) may be 120 Hz. The driving controller 120 may output the data signal at a low frequency (e.g., a predetermined low frequency) when the display panel 110 is driven in the low frequency driving mode. For example, the low frequency (e.g., the predetermined low frequency) may be lower than 15 Hz. For example, the low frequency (e.g., the predetermined low frequency) may be 1 Hz.

The driving controller 120 may output the data signal in at least one driving frequency higher than the predetermined low frequency during the image transition period when the image is changed in the low frequency driving mode. In some example embodiments, the driving controller 120 may sequentially decrease the driving frequency during the image transition period. In other example embodiments, the driving controller 120 may non-sequentially change the driving frequency during the image transition period. The driving frequency changed during the image transition period may be higher than the low frequency (e.g., the predetermined low frequency). The driving controller 120 may improve the response speed of the pixel PX by outputting the data signal in a driving frequency higher than the low frequency (e.g., the predetermined low frequency) during the image transition period in the low frequency driving mode. Thus, the display device 100 may prevent or reduce instances of the sticking image being generated on the display panel 110 when the image is changed in the low frequency driving mode. Further, the driving controller 120 may prevent or reduce instances of a flicker being generated due to a rapid luminance difference by outputting the data signal in at least one driving frequency during the image transition period in the low frequency driving mode.

The driving controller 120 may generate the data voltage Vdata corresponding to the data signal based on a gamma voltage (e.g., a predetermined gamma voltage). The driving controller 120 may output the data voltage Vdata to the pixels PX.

The driving controller 120 may generate a scan control signal CTLS that controls the scan driver 130 based on an input control signal CON provided from the external device. For example, the scan control signal CTLS may include a vertical start signal and a clock signal. The driving controller 120 may provide the scan control signal CTLS to the scan driver 130.

The scan driver 130 may generate a scan signal SS based on the scan control signal CTLS. The scan driver 130 may output the scan signal SS to the pixels PX. For example, the scan signal SS may be the first data writing gate signal GWP and the second data writing gate signal GWN provided to the pixel PX of FIG. 3. The scan driver 130 may be mounted on the display panel 110, or may be coupled to the display panel by being implemented as a chip on film (COF).

As described above, the display device 100 according to some example embodiments may prevent or reduce instances of the sticking image being generated during the image transition period in the low frequency driving mode by outputting the data signal in at least one driving frequency higher than the low frequency (e.g., the predetermined low frequency). Further, the display device 100 according to some example embodiments may prevent or reduce instances of the flicker generated due to the rapid luminance change during the image transition period by outputting the data signal in at least one driving frequency.

Figure 4:
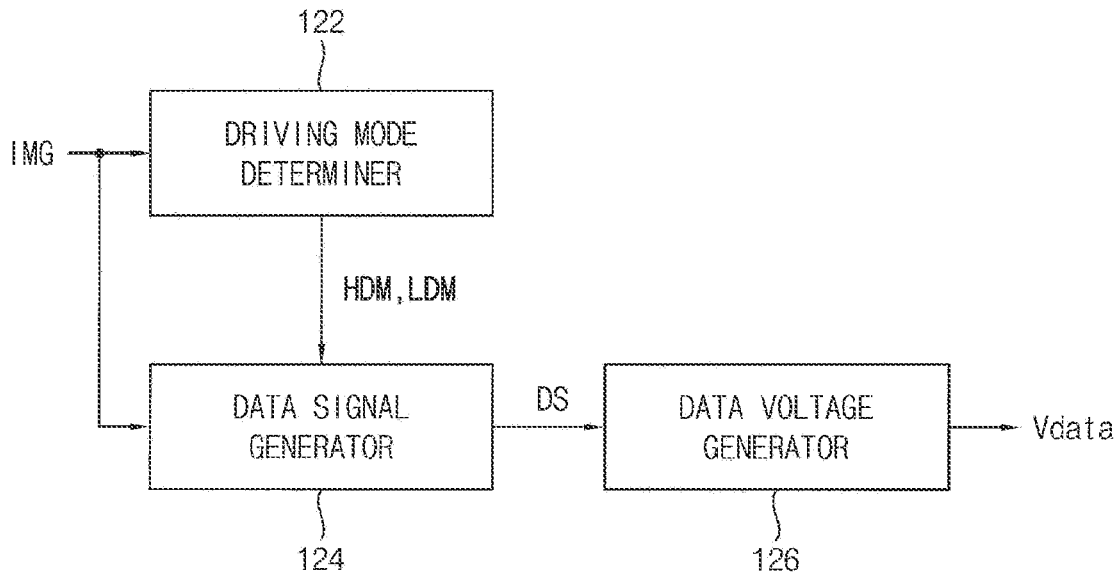
FIG. 4 is a block diagram illustrating a driving controller included in the display device according to some example embodiments.

FIG. 4 is a block diagram illustrating a driving controller included in the display device. FIG. 5 is a diagram illustrating for describing an operation of a data signal generator included in the driving controller of FIG. 4.

Referring to FIG. 4, the driving controller 120 may include a driving mode determiner 122, a data signal generator 124, and a data voltage generator 126.

The driving mode determiner 122 may determine the driving mode of the display panel based on the input image data IMG. For example, the driving mode determiner 122 may compare the input image data IMG of successive frames and determine whether an image displayed on the display panel is the moving image or the still image based on the comparing result. The driving mode determiner 122 may drive the display panel in the high frequency driving mode HDM when the input image data IMG is the moving image and drive the display panel in the low frequency driving mode LDM when the input image data is the still image.

The data signal generator 124 may generate the data signal DS corresponding to the input image data IMG, determine a driving frequency of the data signal DS, and output the data signal DS based on the driving frequency.

The data signal generator 124 may generate the data signal DS corresponding to the input image data IMG.

The data signal generator 124 may determine the driving frequency of the data signal DS based on the driving mode of the display panel and output the data signal based on the driving frequency. When the display panel is driven in the high frequency driving mode HDM, the data signal generator 124 may determine the driving frequency of the data signal DS to be the high frequency (e.g., the predetermined high frequency) and output the data signal DS at the high frequency (e.g., the predetermined high frequency). When the display panel is driven in the low frequency driving mode LDM, the data signal generator 124 may determine the driving frequency of the data signal DS to be the low frequency (e.g., the predetermined low frequency) and output the data signal DS in the low frequency (e.g., the predetermined low frequency). The data signal generator 124 may output the data signal DS in at least one driving frequency when the image is changed in the low frequency driving mode LDM.

Referring to FIG. 5, when a first input image data IMG1 is changed to a second input image data IMG2 in the low frequency driving mode LDM, the data signal generator 124 may drive the display panel in a first low frequency period LP1, an image transition period, and a second low frequency period LP2.

The data signal generator 124 may generate a first data signal DS1 corresponding to the first input image data IMG1 and output the first data signal DS1 at a first low frequency (e.g., a predetermined first low frequency) LF1 during the first low frequency period LP1. For example, the first low frequency LF1 may be 1 Hz.

The data signal generator 124 may generate a second data signal DS2 corresponding to the second input image data IMG2 and output the second data signal DS2 at a first transition frequency CF1, a second transition frequency CF2, a third transition frequency CF3, and a fourth transition frequency CF4. Here, at least one of the first transition frequency CF1, the second transition frequency CF2, the third transition frequency CF3, and the fourth transition frequency CF4 may be higher than the first low frequency LF1. In some example embodiments, the first transition frequency CF1, the second transition frequency CF2, the third transition frequency CF3, and the fourth transition frequency CF4 may be sequentially decreased. For example, the first transition frequency CF1 may be 60 Hz, the second transition frequency CF2 may be 30 Hz, the third transition frequency CF3 may be 15 Hz, and the fourth transition frequency CF4 may be 7.5 Hz.

In other example embodiments, the first transition frequency CF1, the second transition frequency CF2, the third transition frequency CF3, and the fourth transition frequency CF4 may be non-sequentially changed. For example, the first transition frequency CF1 may be 60 Hz, the second transition frequency CF2 may be 30 Hz, the third transition frequency CF3 may be 15 Hz, and the fourth transition frequency CF4 may be 10 Hz. Although the data signal generator 124 that outputs the second data signal DS2 in the first through fourth transition frequencies CF1 through CF4 during the image transition period CP is described in FIG. 5, an operation of the data signal generator 124 may not limited thereto. For example, the data signal generator 124 may output the second data signal DS2 in first through eighth transition frequencies.

The data signal generator 124 may generate the second data signal DS2 corresponding to the second input image data IMG2 during the second low frequency period LP2 and output the second data signal DS2 at a low frequency (e.g., a predetermined low frequency) LF2. In some example embodiments, the second low frequency LF2 may be the same as the first low frequency LF1. For example, the first low frequency LF1 and the second low frequency LF2 may be 1 Hz. In other example embodiments, the second low frequency LF2 may be different from the first low frequency LF1. For example, the first low frequency LF1 may be 1 Hz and the second low frequency LF2 may be 2 Hz.

Referring to FIG. 4, the data voltage generator 126 may generate the data voltage Vdata corresponding to the data signal DS based on the gamma voltage (e.g., the predetermined gamma voltage). For example, the data voltage generator 126 may generate first data voltage corresponding to the first data signal and generate second data voltage corresponding to the second data signal based on the gamma voltage. The data voltage generator 126 may output the data voltage to the pixels.

As described above, the driving controller 120 may increase the response speed of the pixel by including the image transition period CP during which the second data signal DS2 is output in the driving frequency higher than the first low frequency in which the first data signal DS1 is output when the first input image data IMG1 is changed to the second input image data IMG2 in the low frequency driving mode. Thus, the image sticking of the first input image data IMG1 may be prevented or reduced. Further, the driving controller 120 may prevent or reduce instances of the flicker being generated due to the rapid luminance change by outputting the second data signal DS2 in at least one driving frequency during the image transition period CP.

FIGS. 6A and 6B illustrate examples for describing an operation of the data signal generator included in the driving controller of FIG. 4.

Referring to FIG. 6A, the data signal generator may output the first data signal corresponding to the first input image data in 1 Hz during the first low frequency period LP1 during which the image corresponding to the first input image data is displayed on the display panel in the low frequency driving mode. The data signal generator may output the second data signal corresponding to the second input image data in 60 Hz, 30 Hz, 15 Hz, 7 Hz, and 5 Hz during the image transition period CP when the first input image data is changed to the second input image data. The data signal generator may output the second data signal corresponding to the second input image data in 1 Hz during the second low frequency period LP2.

Referring to FIG. 6B, the data signal generator may output the first data signal corresponding to the first input image data in 2 Hz during the first low frequency period LP1 during which the image corresponding to the first input image data is displayed on the display panel in the low frequency driving mode. The data signal generator may output the second data signal corresponding to the second input image data in 60 Hz, 35 Hz, 10 Hz, 15 Hz, 3 Hz, 4 Hz, and 1 Hz during the image transition period CP when the first input image data is changed to the second input image data. The data signal generator may output the second data signal corresponding to the second input image data in 2 Hz during the second low frequency period LP2.

Referring to FIG. 6C, the data signal generator may output the first data signal corresponding to the first input image data in 1 Hz during the first low frequency period LP1 during which the image corresponding to the first input image data is displayed on the display panel in the low frequency driving mode. The data signal generator may output the second data signal corresponding to the second input image data in 60 Hz, 30 Hz, 30 Hz, 10 Hz, 4 Hz, 4 Hz, and 4 Hz during the image transition period CP when the first input image data is changed to the second input image data. The data signal generator may output the second data signal at least once in the same frequency as described in FIG. 6C. The data signal generator may output the second data signal corresponding to the second input image data in 2 Hz during the second low frequency period LP2.

Referring to FIG. 6D, the data signal generator may output the first data signal corresponding to the first input image data in 1 Hz during the first low frequency period LP1 during which the image corresponding to the first input image data is displayed on the display panel in the low frequency driving mode. The data signal generator may output the second data signal corresponding to the second input image data in 60 Hz, 60 Hz, 30 Hz, 30 Hz, 15 Hz, 15 Hz, 15 Hz, and 5 Hz during the image transition period CP when the first input image data is changed to the second input image data. The data signal generator may output the second data signal at least once in the same frequency as described in FIG. 6D. The data signal generator may output the second data signal corresponding to the second input image data in 2 Hz during the second low frequency period LP2. That is, the second low frequency in the second low frequency period LP2 may be different from the first low frequency in the first low frequency period LP1.

As described above, the data signal generator may prevent or reduce instances of the sticking image being generated due to the response speed of the pixel by temporally increasing the driving frequency of the second data signal during the transition period CP. Further, the data signal generator may prevent or reduce instances of the flicker being generated due to the rapid luminance change by gradually changing the driving frequency of the second data signal during the transition period CP.

Figure 7:
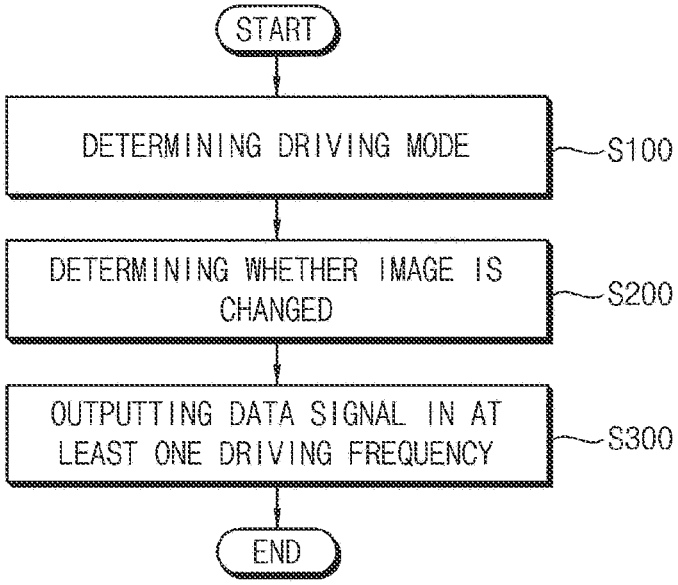
FIG. 7 is a flow chart illustrating a driving method of a display device according to some example embodiments.

FIG. 7 is a flow chart illustrating a driving method of a display device according to some example embodiments.

Referring to FIG. 7, a driving method of a display device may include an operation of determining a driving mode of a display panel S100, an operation of determining whether an image is changed in a low frequency driving mode S200, and an operation of outputting a data signal corresponding to input image signal in at least one driving frequency when the image is changed in the low frequency driving mode S300. Embodiments of the present invention may vary, however, and some example embodiments may include additional or alternative operations, and the order of the operations may vary according to some example embodiments unless otherwise expressly or implicitly stated.

The driving method of the display device may determine the driving mode of the display panel 100. The driving method of the display device may determine the driving mode of the display panel based on the input image data. For example, the driving method of the display device may compare the input image data of successive frames and determine whether the display panel is the moving image or still image. The driving method of the display device may drive the display panel in the high frequency driving mode when the input image data is the moving image and drive the display panel in the low frequency driving mode when the input image data is the still image.

The driving method of the display device may determine whether or not the image is changed in the low frequency driving mode S200. For example, the driving method of the display device may compare the input image data of successive frames in the low frequency driving mode and determine whether or not the image is changed based on a comparing result.

The driving method of the display device may output the data signal corresponding to the input image signal in at least one driving frequency when the image is changed in the low frequency driving mode S300. The driving method of the display device may output the data signal at a low frequency (e.g., a predetermined low frequency) in the low frequency driving mode. The driving method of the display device may output the data signal at at least one driving frequency higher than the low frequency (e.g., the predetermined low frequency) when the image is changed in the low frequency driving mode. In some example embodiments, the driving frequency may be sequentially decreased. In other example embodiments, the driving frequency may be non-sequentially changed. For example, when the image is changed in the low frequency driving mode, the data signal may be output in a first driving frequency and a second driving frequency. In some example embodiments, the first driving frequency may be higher than the second driving frequency. In other example embodiments, the first driving frequency may be lower than the second driving frequency. In some example embodiments, the data signal may be output in the first driving frequency at least once. In other example embodiments, the data signal may be output in the second driving frequency at least once.

As described above, the driving method of the display device may prevent or reduce instances of an image sticking by outputting the data signal in at least one driving frequency higher than the low frequency (e.g., the predetermined low frequency) when the image is changed in the low frequency driving mode.

Embodiments of the present inventive concept may be applied to a display device and an electronic device having the display device. For example, embodiments of the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of aspects of some example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A method of driving a display device in a low frequency driving mode, the method comprising:

displaying a first still image on a display panel at a first driving frequency, the first driving frequency being lower than a normal driving frequency at which a moving image is displayed on the display panel in a normal frequency driving mode;

determining that an image to be displayed on the display panel is changed from the first still image to a second still image that is different from the first still image;

displaying the second still image on the display panel at one or more transition frequencies during an image transition period; and displaying, after the image transition period, the second still image on the display panel at a second driving frequency, the second driving frequency being lower than the normal driving frequency.

2. The method of claim 1, wherein each of the transition frequencies is higher than the first driving frequency.

3. The method of claim 1, wherein each of the transition frequencies is higher than the second driving frequency.

4. The method of claim 1, wherein the transition frequencies are sequenced to be smaller as the image transition period elapses.

5. The method of claim 4, wherein the transition frequencies are different from each other.

6. The method of claim 4, wherein at least two of the transition frequencies are the same.

7. The method of claim 1, wherein the transition frequencies are randomly sequenced during the image transition period.

8. The method of claim 7, wherein the transition frequencies are different from each other.

9. The method of claim 7, wherein at least two of the transition frequencies are the same.

* * * * *